US006050096A

United States Patent [19]

Senior

[11] Patent Number: 6,050,096

[45] Date of Patent: Apr. 18, 2000

[54] FUEL INJECTOR ARRANGEMENT FOR A COMBUSTION APPARATUS

[75] Inventor: Peter Senior, Countesthorpe, United Kingdom

[73] Assignee: European Gas Turbines Ltd., United Kingdom

[21] Appl. No.: 09/029,822

[22] PCT Filed: Sep. 4, 1996

[86] PCT No.: PCT/GB96/02173

§ 371 Date: Apr. 21, 1998

§ 102(e) Date: Apr. 21, 1998

[87] PCT Pub. No.: WO97/12178

PCT Pub. Date: Apr. 3, 1997

[30] Foreign Application Priority Data

Sep. 25, 1995 [GB] United Kingdom ..... 9519547

[51] Int. Cl.[7] ..... F23C 7/00

[52] U.S. Cl. ..... 60/748; 60/737; 239/463

[58] Field of Search ..... 60/748, 737; 239/463

[56] References Cited

U.S. PATENT DOCUMENTS

| | | | |
|---|---|---|---|
| 2,752,753 | 7/1956 | Dooley | 60/39.74 |
| 5,251,447 | 10/1993 | Joshi et al. . | |
| 5,274,995 | 1/1994 | Horner et al. . | |
| 5,658,358 | 8/1997 | Chyou et al. | 48/180.1 |

FOREIGN PATENT DOCUMENTS

| | | |
|---|---|---|
| 0 393 484 A1 | 10/1990 | European Pat. Off. . |
| 0 660 038 A2 | 6/1995 | European Pat. Off. . |
| 1160902 | 3/1958 | France . |
| 2 198 521 | 6/1988 | United Kingdom . |
| 2 272 756 | 5/1994 | United Kingdom . |
| WO 95/02789 | 1/1995 | WIPO . |

*Primary Examiner*—Ehud Gartenberg
*Attorney, Agent, or Firm*—Kirschstein, et al.

[57] ABSTRACT

A fuel arrangement for a combustion apparatus, comprises at least one passage for the flow of fluid, the passage being of substantially annular cross section, being defined by a radially inner wall and a radially outer wall and having an inlet region and an outlet region. The inlet region incorporates a plurality of vanes adapted to modify a flow pattern of a fluid entering the inlet region, such that fluid passing from the inlet region to the outlet region has a composite flow pattern having both an axial component and a rotational component about the longitudinal axis of the passage.

31 Claims, 3 Drawing Sheets

FUEL INJECTOR ARRANGEMENT FOR A COMBUSTION APPARATUS

BACKGROUND OF THE INVENTION

This invention relates to a fuel injector arrangement for a combustion apparatus utilising fluid fuel. It is concerned particularly, but not exclusively, with such an injector arrangement for a turbine, especially a gas turbine, but it is also suitable for use with liquid fuels and in combustion apparatus other than turbines.

Various fuel injectors have been described in the art. For example in EP 0 660 038 there is described a fuel injection apparatus in which fuel is supplied to an annular lip on an annular member and the fuel is then atomised, as it flows from the lip, by first and second coaxial airflows created by first and second arrays of swirler vanes.

Various arrangements of introducing fuel into an air flow have been described, e.g. in WO 95/02789 gas injectors are shown provided in swirl vanes. Further, curved swirl vanes have been described (see e.g. EP 0393 484).

SUMMARY OF THE INVENTION

Environmental considerations per se, as well as legislation in the environmental field mean that it has become essential to ensure that the levels of pollutant emission from all combustion apparatus and in particular the emission of the nitrogen oxides ($NO_x$) is reduced to as low levels as possible. One way of reducing such emission is to ensure efficient mixing of the air/fuel mixture to thereby obtain efficient combustion. Various injection and mixing arrangements have been described which purport to give efficient mixing but in practice it has been found difficult to ensure such mixing over the wide range of fuel-air ratios encountered in practice, and especially ratios encountered under low-power conditions, i.e. close to flame extinction.

It is an object of the present invention to provide a fuel injection arrangement, e.g. for a turbine, which gives efficient mixing and combustion over a wide range of fuel-air ratios and thereby ensures low $NO_x$ emissions over a range of operating conditions.

According to the invention there is provided a fuel injector arrangement for a combustion apparatus, comprising at least one passage for the flow of fluid, said passage being of substantially annular cross-section, being defined by a radially inner wall and a radially outer wall and having an inlet region and an outlet region, wherein the inlet region incorporates a plurality of vanes adapted to modify a flow pattern of a fluid entering said inlet region, such that fluid passing from the inlet region to the outlet region has a composite flow pattern having both an axial component and a component rotational about the longitudinal axis of the passage wherein each vane is provided with a root and a mid-region and a tip, the vane being contoured such that an existing axial flow of fluid entering said inlet region continues substantially unaffected at the root and tip but is partly converted into a rotational flow as it flows past the mid-region.

In a preferred arrangement the root and/or the tip are of reduced width relative to the mid-region.

It is further preferred that the vanes are adapted to provide a continuous radial variation in said axial and rotational components.

It is particularly contemplated that progressively between the root and the mid-region and between the tip and the mid-region, the fluid is given a rotational component whereby the fluid is caused to spiral along the passage.

Each vane may be set at an angle to a longitudinal axis of the injector arrangement.

In one embodiment it is provided that, in use, air enters the inlet region and fuel enters the annular passage at at least one position between the inlet region and the outlet region; fuel may enter the annular passage through at least one hole in a wall of the annular passage, and/or fuel may enter the annular passage through at least one hole in a said vane.

Each vane may have a straight leading edge and a curved trailing edge and the trailing edge may be of convex or concave form as viewed in the direction of an axial fluid flow component.

Alternatively the leading edge may be curved.

The trailing edge and/or the leading edge of each vane may have a corrugated surface formation.

It is envisaged that each vane may have a crescent shaped cross-section, and the sides of each vane may be curved axially along the annular passage.

The inlet region of the annular passage may be provided by a disc formed with slots and in this arrangement each vane may be provided by a wall between adjacent said slots.

In particular, each wall may extend substantially radially and the radially inner and outer walls of each slot may be straight or curved.

The annular passage may surround a central axial bore for the flow of fuel and/or air, in use, and the central bore may incorporate at least one vane to give a rotational component to the flow of fluid fuel and/or air therethrough; means may be provided for injecting fuel substantially tangentially into the central bore. The rotational component of flow through the central bore may be counter to or in the same rotational direction as the rotational flow component of fluid flow in the annular passage.

The central bore is preferably arranged, in use, to provide the fuel/air mixture for a pilot flame, the annular passage providing the fuel/air mixture for a main flame; in use the main flame and pilot flame may coalesce to give a flame of crown-shaped formation.

BRIEF DESCRIPTION OF THE DRAWINGS

The outlet region of the annular passage may be provided by a component which acts to give a coanda jet flow of air to improve flame stability.

The annular flow passage may be formed by spaced surfaces of two components with the radially inner component being formed with the said central bore.

Figure 1:
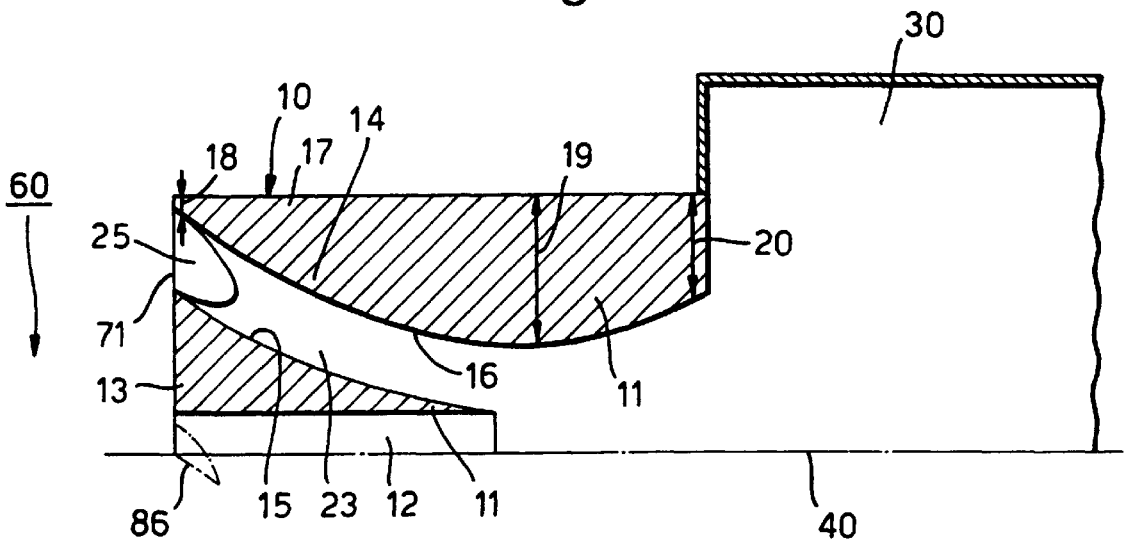
Figure 2A:
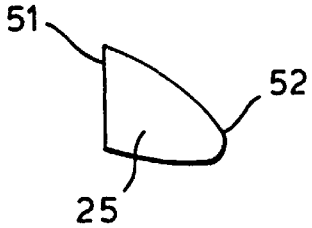

Embodiments of the invention will now be described, by way of example, with reference to the accompanying drawings in which:

FIG. 1 shows a part section of one embodiment of a fuel injector arrangement according to the invention;

FIG. 2*a,* 2*b* respectively show a side view and an end view of a vane for use in the injector arrangement of FIG. 1;

DETAILED DESCRIPTION OF THE PREFERRED EMBODIMENTS

Figure 3A:
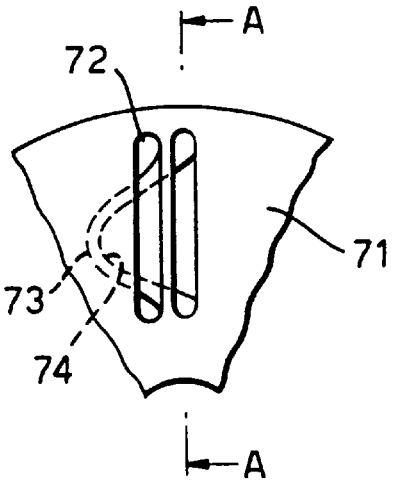
Figure 3B:
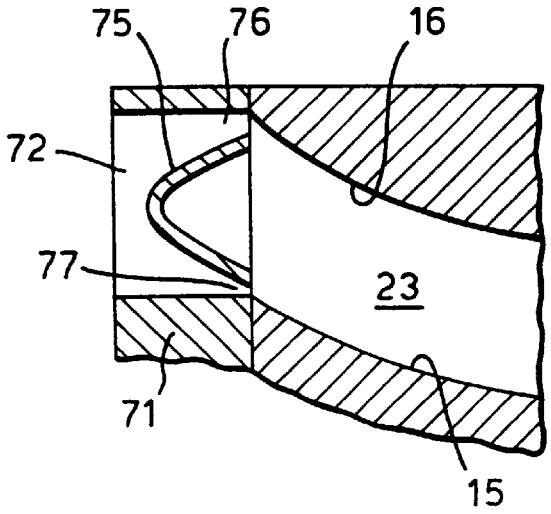
Figure 4A:
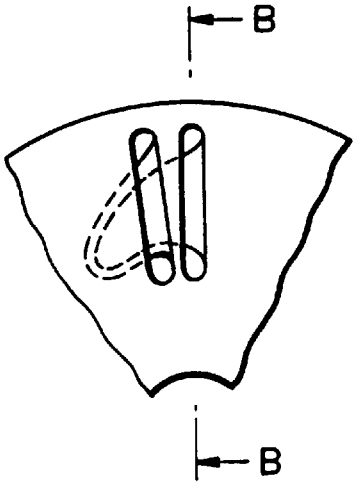
Figure 4B:
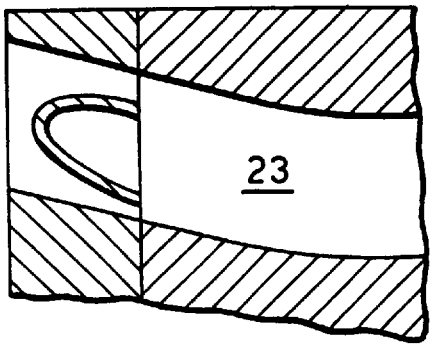

FIG. 3*a* shows part of the upstream face of a disc of an injector arrangement according to the invention and FIG. 3*b* shows a section on line A—A of FIG. 3*a*;

FIG. 4*a* shows part of the upstream face of an alternative disc and FIG. 4*b* shows a section on line B—B of FIG. 4*a;*

Figure 5:
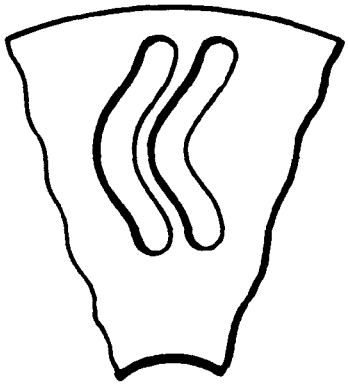
Figure 6:
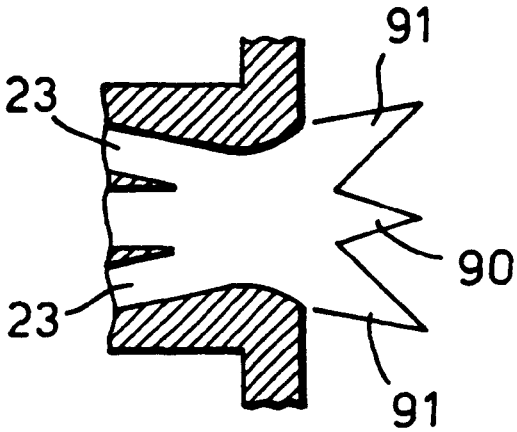

FIG. 5 shows a face of an alternative disc;

FIG. 6 illustrates a flame formation produced in a fuel injector arrangement according to the invention.

Figure 7:
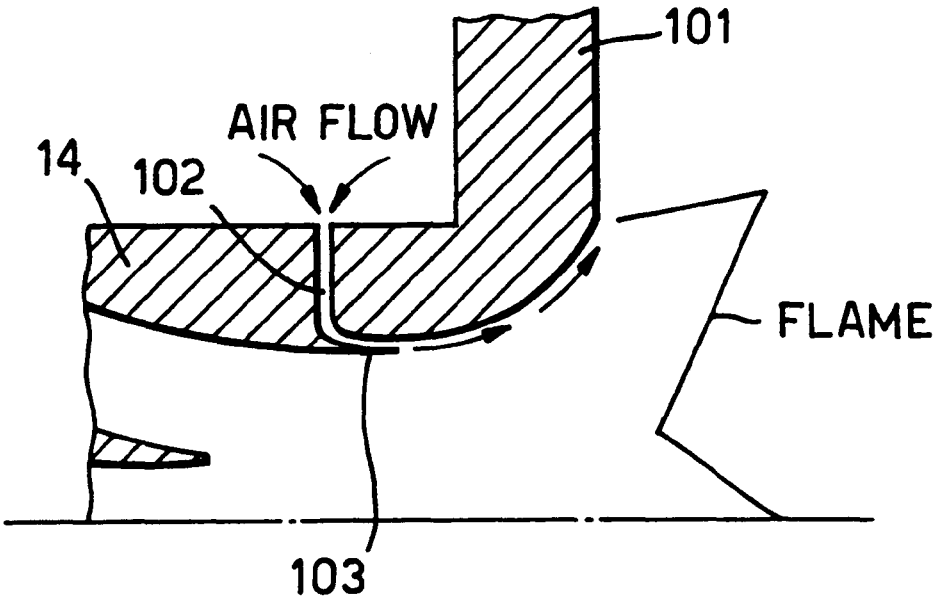

FIG. 7 is a part sectional view of a further fuel injector according to the invention.

The embodiment of FIG. 1 shows a fuel injector arrangement 10 to which are fed supplies of fuel and air for mixing to give a combustible mixture for combustion in a combustion chamber 30 to which the fuel injector arrangement is attached; it is also envisaged that 30 may represent a precombustion chamber with combustion occurring further downstream The arrangement 10 has a generally cylindrical body 11 having its longitudinal axis identified by broken line 40 and comprising a first part 13 and second part 14, the first body part 13 being formed with a central cylindrical axial bore 12. The first part 13 has a generally frustoconical external form being tapered in the direction towards the combustion chamber 30 but with its outer surface 15 also being curved to provide a concave surface as shown. The body part 14 is of overall externally cylindrical form but it has an inner surface 16 curved in convex manner such that the thickness of the wall 17 of body part 14 increases from a region 18 of minimum thickness towards a region 19 of maximum thickness and then decreases towards a region 20 of intermediate thickness at which region 20 the body part 14 is secured to the upstream end of the combustion chamber 30.

The surfaces 15, 16 have similar curvatures with the concave surface 15 of the body part 13 facing the convex surface 16 of the body part 14 between the regions 18, 19 thereof whereby a passage 23 is formed therebetween, the passage 23 having a substantially annular cross-section but with its bounding longitudinal walls formed by the curved surfaces 15, 16 so that the diameter of the annular passage decreases in an axial downstream direction, i.e. its distance from axis 40 decreases in the downstream direction.

In the embodiment thus far described the body parts 13, 14 are formed as separate components which are suitably secured to adjacent elements to form the passage 23 therebetween, as shown. In other embodiments it may be possible for the body parts 13, 14 to be formed integrally, e.g. by casting with suitable supporting/interconnecting means between the parts 13, 14. Furthermore it is envisaged that the body parts 13, 14 may be formed and/or positioned and/or interconnected such that instead of a single annular passage a plurality of separate annular passages are formed around the central bore 12.

The fuel injector arrangement 10 receives air and fuel and mixes them in such a manner as to form a lean mixture for efficient combustion with low $NO_x$ production.

For the purpose of such mixing, there are provided in the or each annular passage 23 a plurality of vanes 25 adapted and arranged to give to fluid passing through the passage 23 a composite flow pattern having both an axial component and a component rotational about the longitudinal axis of passage 23, both components varying in a controlled fashion in the radial direction; the disposition of passage 23 effectively means that each vane 25 is set at an angle to the longitudinal axis 40 of the injector.

Figure 2B:
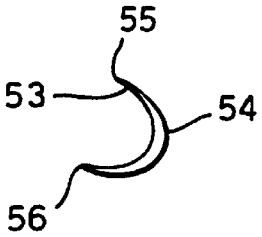

FIGS. 2*a*, 2*b* shows views of one possible form of vane 25. In FIG. 2*a* which represents an overall view of a vane 25 from one side, the leading edge 51 of the vane is seen to be straight and the trailing edge 52 is curved. FIG. 2*b* shows an end-on view looking into the leading edge 51 of the vane 25 and it can be seen that in cross-section the vane is of substantially crescent shape having a concave side 53 and a convex side 54, both sides 53, 54 extending between the root 55 and the tip 56 of the vane. As shown, the root and tip each have a width which is only sufficient to ensure reliable attachment to surfaces 16, 15 respectively, but where fuel passages are provided in the tip/root of the vanes (see below), the root/tip will of course, be wider. The sides 53, 54 are curved also in an axial direction so that the vane 25 has a formation curved in two dimensions. As shown, the positioning of the vane 25 in the passage 23 is such that the concave surface 53 is angled towards the inlet end 71 of the passage 23, but positioning the vane with the convex surface 54 angled towards the inlet end of the passage is also envisaged.

As indicated above, the vanes 25 give a composite flow pattern to the air/fuel mixture leaving the passage 23. There are a number of possible ways of introducing air and/or fuel into the passage whereby this flow pattern is obtained.

In one example, the region 60 upstream of the body 11 is supplied with compressed air by a compressor driven by the turbine. Fuel in gaseous form and for main operation, e.g. engine on load, may be introduced into the passage 23 through bores in the vanes whose exits are formed in the concave and/or convex sides of the vanes 25 and/or through holes (e.g. in fuel posts) in the surfaces 15, 16 defining the passage 23 and/or through a fuel post adjacent inlet 71 within or just outside passage 23. For fuel in liquid form, introduction would normally be through atomiser holes in the surfaces 15, 16 only. Typically, for pilot operation (e.g. engine start-up and low-power operation) and in the case of either gas or liquid fuel, fuel is introduced into the central bore 12 as will be further described later.

Compressed air or, possibly, a preformed air/fuel mixture enters the inlet end 71 of passage 23 with an essentially axial flow pattern. The root 55 and tip 56 position of each vane 25 have, as previously explained, a reduced width or chordal dimension relative to the mid-region of the vane and the shape of the vanes at the root and tip allows an existing axial flow of air to continue substantially unaffected. However, progressively between the root 55 and tip 56 of the vane and the mid region of the vane 25 the air is affected as it flows past the mid-region. Specifically the flow directed by the centre parts of the vane is given a rotational flow component whereby air is caused to spiral along the passage 23. The composite flow receives fuel from the holes in the vanes 25 and/or surfaces 15, 16 as it progresses and engenders thorough mixing to provide a fuel/air mixture without isolated fuel-rich pockets or substantial zones of retarded flow whereby efficient combustion without flash-back- may be obtained.

By means of careful consideration of the aerodynamics of the vanes and the associated components, pre-ignition, which is a common feature of prior-art pre-mixing burners, is avoided.

In the embodiment of FIGS. 1, 2*a* and 2*b* the volume 60 effectively constitutes a simple chamber from which air flows at low velocity, but it would also be advantageous to have means adjacent the inlet 71 of passage 23 to ensure forced axial flow of air thereinto. Such means could comprise inter alia a suitably dimensioned annulus or tube constituting an axial extension of passage 23 at its upstream end which acts to guide air directly to the passage inlet.

In further alternative embodiments illustrated by FIGS. 3*a*, 3*b* and 4*a*, 4*b* composite swirling flow into the passage 23 is achieved by means of a disc 71 formed with an annular array of slots 72 therethrough, which slots 72 have a radial dimension corresponding to that of the passage 23 and act collectively as the inlet region of the passage 23. In these embodiments each slot may be visualised as being skewed as it extends through the disc; each vane 25 may then be visualised as the similarly skewed radially extending wall between a pair of adjacent slots. By appropriate contouring of the slots, the desired contouring of the vanes is achieved to ensure the composite flow pattern.

In the embodiment of FIG. 3*a,* 3*b* the dotted lines 73, 74 indicate the form of such matching contoured surfaces of a slot at the downstream outlet; they can be seen to provide a curved surface angled with respect to the downstream face of the disc 71 and having a convex surface 75 facing the upstream side. Respective axial inclined passages 76, 77 at root and tip act to provide the axial flow component with the angled curved part of the vane in the middle region thereof providing the rotational flow component.

In this embodiment the radially inner and outer walls of the slot are shown as straight whereas in the embodiment of FIGS. 4*a,* 4*b* these walls have a curve corresponding to the curves of the surfaces 15, 16 of passage 23.

FIG. 5 shows a further arrangement with sickle-shaped slots, with the vanes/walls therebetween formed similarly.

As described above, the annular passage 23 gives a fuel/air mixture with a composite flow pattern. The central bore 12 may be utilised in a number of ways depending on the precise application but it is particularly envisaged that an intimate mixture of air and fuel may be formed therein for low emission pilot flame production or to stabilise combustion during low power operation. Furthermore, better mixing may be obtained if the flow of fluid in the central bore 12 is given a rotational component, e.g. by the use of vanes 86 in the bore 12, (see FIG. 1) or by utilising an arrangement whereby the fuel is caused to be injected into the bore tangentially, e.g. from a fuel gallery or galleries. In either case optimum mixing will generally be assured if the rotational direction of flow of fluid exiting central bore 12 is counter to that exiting passage 23.

FIG. 6 illustrates the downstream end of the injector arrangement 10 where the fuel/air mixture exiting the central bore 12 forms a pilot flame 90 and the fuel air mixture exiting the annular passage forms a main flame 91 of annular form surrounding the pilot flame 90, to give an overall flame of crown-shape, which is particularly stable. The streams of air/fuel mixture respectively flowing in passage 12, 23 may be arranged to have the same air/fuel ratios or different ratios. More specifically, $NO_x$ production is minimised if the fuel/air ratios are the same at high firing temperatures, whilst different fuel/air ratios at low firing temperatures will assist in maintaining combustion stability.

In the modification of FIG. 7, the exit region of the injector unit 10 has an additional component 101 associated therewith which may be integral with body part 14 but will generally, and as shown, be a separate component The mounting of component 101 is such that there will be at least one axial gap 102 forming a radially extending channel between component 101 and the downstream end of body part 14. The body part 14 is formed with a lip 103 whereby air flow is directed on exit from radial to axial flow to give a coanda effect jet flow—this will act to prevent flame creep. Each gap may be realised by means of a radial groove in component 14 and/or component 101.

Further modifications of the fuel injector are envisaged, which are specifically aimed at improving air/fuel mixing. Thus the inlet 71 of passage 23 may have crescent or part circular vanes to control air flow entering the passage 23. Further the vanes 25 may be provided with a corrugated trailing edge and/or leading edge to create vortices to assist the mixing process.

I claim:

1. A fuel injector arrangement for a combustion apparatus, comprising:

at least one passage for the flow of fluid, said passage being of substantially annular cross-section, being defined by a radially inner wall and a radially outer wall and having an inlet region and an outlet region, said inlet region incorporating a plurality of vanes adapted to modify a flow pattern of a fluid entering said inlet region, such that fluid passing from the inlet region to the outlet region has a composite flow pattern having both an axial component and a component rotational about the longitudinal axis of the passage, each vane being provided with a root, a mid-region and a tip, each vane being contoured such that an existing axial flow of fluid entering said inlet region continues substantially unaffected at the root and tip but is partly converted into a rotational flow as it flows past the mid-region.

2. The fuel injector arrangement as claimed in claim 1, wherein at least one of the root and the tip is of reduced width relative to the mid-region.

3. The fuel injector arrangement as claimed in claim 1 wherein the vanes are adapted to provide a continuous radial variation in said axial and rotational components.

4. The fuel injector arrangement as claimed in claim 1, wherein each vane is set at an angle to a longitudinal axis of the injector arrangement.

5. The fuel injector arrangement as claimed in claim 1, wherein, progressively between the root and the mid-region and between the tip and the mid-region, the fluid is given a rotational component whereby the fluid is caused to spiral along the passage.

6. The fuel injector as claimed in claim 1, wherein, in use, air enters the inlet region and fuel enters the annular passage at at least one position between the inlet region and the outlet region.

7. The fuel injector arrangement as claimed in claim 6, wherein fuel enters the annular passage through at least one hole in a wall of the annular passage.

8. The fuel injector arrangement as claimed in claim 1, wherein fuel enters the annular passage through at least one hole in one of said vanes.

9. The fuel injector arrangement as claimed in claim 1, wherein each vane has a straight leading edge and a curved trailing edge.

10. The fuel injector arrangement as claimed in claim 9, wherein the trailing edge is of convex form as viewed in the direction of an axial fluid flow component.

11. The fuel injector arrangement as claimed in claim 9, wherein the trailing edge is of concave form as viewed in the direction of an axial fluid flow component.

12. The fuel injector arrangement as claimed in claim 1, wherein each vane has a curved leading edge.

13. The fuel injector arrangement as claimed in claim 9, wherein at least one of the trailing edge and the leading edge has a corrugated surface formation.

14. The fuel injector arrangement as claimed in claim 1, wherein each vane has a crescent shaped cross-section.

15. The fuel injector arrangement as claimed in claim 1, wherein each vane has sides that are curved axially along the annular passage.

16. The fuel injector arrangement as claimed in claim 1, wherein the inlet region of the annular passage is provided by a disc formed with slots.

17. The fuel injector arrangement as claimed in claim 16, wherein each vane is provided by a wall between adjacent said slots.

18. The fuel injector arrangement as claimed in claim 17, wherein each wall extends substantially radially.

19. The fuel injector arrangement as claimed in claim 18, wherein the radially inner and outer walls of each slot are straight.

20. The fuel injector arrangement as claimed in claim 18, wherein the radially inner and outer walls of each slot are curved.

21. The fuel injector arrangement as claimed in claim 1, wherein the annular passage surrounds a central axial bore for the flow of fuel and/or air, in use.

22. The fuel injector arrangement as claimed in claim 21, wherein the central bore incorporates at least one vane to give a rotational component to the flow of fluid fuel and/or air therethrough.

23. The fuel injector arrangement as claimed in claim 21, and farther comprising means for injecting fuel substantially tangentially into the central bore.

24. The fuel injector arrangement as claimed in claim 22, wherein the rotational component of flow through the central bore is counter to the rotational flow component of fluid flow in the annular passage.

25. The fuel injector arrangement as claimed in claim 22, wherein the rotational component of flow through the central bore is in the same rotational direction as the rotational flow component of fluid flow in the annular passage.

26. The fuel injector arrangement as claimed in claim 21, wherein the central bore is arranged, in use, to provide the fuel/air mixture for a pilot flame, the annular passage providing the fuel/air mixture for a main flame.

27. The fuel injector arrangement as claimed in claim 26, wherein, in use, the main flame and the pilot flame coalesce to give a flame of crown-shaped formation.

28. The fuel injector arrangement as claimed in claim 1, wherein the outlet region of the annular passage is provided by a component which acts to give a coanda jet flow of air to improve flame stability.

29. The fuel injector arrangement as claimed in claim 1, wherein the annular flow passage is formed by spaced surfaces of two components.

30. The fuel injector arrangement as claimed in claim 29, wherein the radially inner component is formed with the said central bore.

31. A gas turbine arrangement including a fuel injector arrangement for a combustion apparatus, comprising: at least one passage for the flow of fluid, said passage being of substantially annular cross-section, being defined by a radially inner wall and a radially outer wall and having an inlet region and an outlet region, said inlet region incorporating a plurality of vanes adapted to modify a flow pattern of a fluid entering said inlet region, such that fluid passing from the inlet region to the outlet region has a composite flow pattern having both an axial component and a component rotational about the longitudinal axis of the passage, each vane being provided with a root, a mid-region and a tip, each vane being contoured such that an existing axial flow of fluid entering said inlet region continues substantially unaffected at the root and tip but is partly converted into a rotational flow as it flows past the mid-region.

* * * * *